US011515678B2

(12) United States Patent
Kightlinger et al.

(10) Patent No.: US 11,515,678 B2
(45) Date of Patent: Nov. 29, 2022

(54) SPLICE CONNECTOR

(71) Applicant: Aptiv Technologies Limited, St. Michael (BB)

(72) Inventors: John Kightlinger, Canfield, OH (US); Don E. Bizon, Boardman, OH (US); Michael L. Mellott, Youngstown, OH (US)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 93 days.

(21) Appl. No.: 16/952,753

(22) Filed: Nov. 19, 2020

(65) Prior Publication Data

US 2021/0218203 A1 Jul. 15, 2021

Related U.S. Application Data

(60) Provisional application No. 62/958,769, filed on Jan. 9, 2020.

(51) Int. Cl.

| | |
|---|---|
| ***H01R 4/66*** | (2006.01) |
| ***H01R 25/00*** | (2006.01) |
| ***H01R 13/504*** | (2006.01) |
| ***H01R 43/02*** | (2006.01) |

(52) U.S. Cl.
CPC ..... *H01R 25/003* (2013.01); *H01R 13/504* (2013.01); *H01R 43/0207* (2013.01)

(58) Field of Classification Search
CPC ..... H01R 13/65802; H01R 23/662; H01R 23/688; H01R 13/4532
See application file for complete search history.

(56) References Cited

U.S. PATENT DOCUMENTS

| | | | | |
|---|---|---|---|---|
| 6,217,372 | B1 * | 4/2001 | Reed | H01R 13/6593 439/497 |
| 7,857,657 | B2 * | 12/2010 | Kuwahara | H01R 12/62 439/497 |
| 9,887,529 | B2 | 2/2018 | Dew et al. | |
| 9,906,003 | B1 | 2/2018 | Volpone et al. | |
| 9,917,434 | B2 | 3/2018 | George et al. | |
| 9,928,939 | B1 | 3/2018 | Volpone et al. | |

(Continued)

FOREIGN PATENT DOCUMENTS

| | | |
|---|---|---|
| CN | 101282815 A | 10/2008 |
| CN | 101811219 A | 8/2010 |

OTHER PUBLICATIONS

Extended European Search Report for EP Application No. 20212677.7, dated May 11, 2021, 9 pages.

(Continued)

*Primary Examiner* — Phuong Chi Thi Nguyen
(74) *Attorney, Agent, or Firm* — Billion & Armitage

(57) ABSTRACT

A splice connector assembly configured to conduct more than 1 kilowatt of electricity includes a terminal having a connection portion configured to interconnect with a corresponding mating terminal. The terminal also has an attachment portion. The attachment portion has a planar shape. The attachment portion is attached to a first wire electrical cable and is also attached to a second wire electrical cable. The first cable has a different cross-sectional area than the second cable. The splice connector assembly also includes a dielectric housing defining a cavity in which the terminal is disposed.

20 Claims, 5 Drawing Sheets

(56) References Cited

U.S. PATENT DOCUMENTS

| | | | | |
|---|---|---|---|---|
| 10,236,612 | B2 | 3/2019 | Meier et al. | |
| 2004/0229510 | A1* | 11/2004 | Lloyd ..... | H01R 13/65912 439/607.01 |
| 2008/0265004 | A1 | 10/2008 | Stroh | |
| 2016/0164230 | A1 | 6/2016 | Hanke et al. | |
| 2018/0309231 | A1 | 10/2018 | Sakaguchi | |

OTHER PUBLICATIONS

"Non Final Office Action for Chinese Patent Application 202011508973.8 dated Aug. 22, 2022", 7 Pages.

* cited by examiner

SPLICE CONNECTOR

CROSS-REFERENCE TO RELATED APPLICATION

This application claims benefit of priority to U.S. Provisional Patent Application No. 62/958,769 filed on Jan. 9, 2020, the entire disclosure of which is hereby incorporated by reference.

TECHNICAL FIELD

The invention generally relates to a connector assembly, particularly to a connector assembly having two wires attached to a single terminal, thereby forming a wire splice.

BACKGROUND

Wiring assemblies in electric or hybrid electric vehicles typically include high power circuits (exceeding 1 kilowatt) that interconnect a power source, such as a battery pack, to various high-power components in the vehicle. The high-power circuits typically have a wire cable with a large cross-sectional area (e.g. 95 $mm^2$) connected directly to the power source by a connector having a cable terminal. The high-power circuit also contains a Y-splice device connecting the wire cable with the large cross-sectional area to two wire cables each having a smaller cross-sectional area, e.g. 75 $mm^2$ and 25 $mm^2$. Various examples of these Y-splice devices can be found in U.S. Pat. Nos. 9,887,529, 9,906,003, 9,917,434, and 9,928,939. However, this high-power circuit construction has the drawbacks of the cost of the Y-splice device and the labor cost and time to assemble the Y-splice device into the high-power circuit. The Y-splice device has the further drawback of requiring packaging space within the vehicle which is typically at a premium.

Therefore, a high-power circuit configured to connect a power source to multiple high-power devices that eliminates at least some of the drawbacks of the current circuits described above remains desired.

The subject matter discussed in the background section should not be assumed to be prior art merely because of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

SUMMARY

According to an embodiment of the invention, a splice connector assembly configured to conduct more than 1 kilowatt of electricity is provided. The splice connector assembly includes a terminal having a connection portion configured to interconnect with a corresponding mating terminal and having an attachment portion. The attachment portion has a planar shape. The attachment portion is attached to a first wire electrical cable and is also attached to a second wire electrical cable. The first cable has a different cross-sectional area than the second cable. The splice connector also includes a dielectric housing defining a cavity in which the terminal is disposed.

In an example embodiment having one or more features of the splice connector assembly of the previous paragraph, a first cross-sectional area of the first cable is at least 25 square millimeters and a second cross-sectional area of the second cable is greater than first cross-sectional area.

In an example embodiment having one or more features of the splice connector assembly of any one of the previous paragraphs, the first and second cables are welded to the attachment portion.

In an example embodiment having one or more features of the splice connector assembly of any one of the previous paragraphs, the first and second cables are sonically welded to the attachment portion.

In an example embodiment having one or more features of the splice connector assembly of any one of the previous paragraphs, the splice connector assembly further includes a terminal position assurance device defining a lance configured to contact the attachment portion of the terminal, thereby securing the terminal within the cavity.

In an example embodiment having one or more features of the splice connector assembly of any one of the previous paragraphs, the lance is formed of a dielectric material and the lance is positioned between the first and second cables, thereby electrically insulating first cable from the second cable.

In an example embodiment having one or more features of the splice connector assembly of any one of the previous paragraphs, the terminal is a first terminal having a first connection portion and a first attachment portion and the cavity is a first cavity. The splice connector assembly further includes a second terminal having a second connection portion and having a planar second attachment portion. The second attachment portion is attached to a third wire electrical cable and is also attached to a fourth wire electrical cable. The third cable has a different cross-sectional area than the second cable. The housing defines a second cavity in which the second terminal is disposed.

In an example embodiment having one or more features of the splice connector assembly of any one of the previous paragraphs, the second terminal is rotated 180 degrees relative to the first terminal.

In an example embodiment having one or more features of the splice connector assembly of any one of the previous paragraphs, the first cable has the same cross-sectional area as the third cable and the second cable has the same cross-sectional area as the fourth cable.

According to another embodiment of the invention, a method of assembling a splice connector assembly configured to conduct more than 1 kilowatt of electricity is provided. The method includes the steps of:

- providing a terminal having a connection portion configured to interconnect with a corresponding mating terminal and having an attachment portion, wherein the attachment portion has a planar shape, attaching a first wire electrical cable to the attachment portion;
- attaching a second wire electrical cable to the attachment portion, wherein the first cable has a different cross-sectional area than the second cable; and
- inserting the terminal within a cavity defined by a dielectric housing.

In an example embodiment having one or more features of the method of the previous paragraph, a first cross-sectional area of the first cable is at least 25 square millimeters and a second cross-sectional area of the second cable is greater than first cross-sectional area.

In an example embodiment having one or more features of the method of any one of the previous paragraphs, the method further includes the step of welding the first and second cables to the attachment portion.

In an example embodiment having one or more features of the method of any one of the previous paragraphs, the method further includes the step of sonically welding the first and second cables to the attachment portion.

In an example embodiment having one or more features of the method of any one of the previous paragraphs, the method further includes the step of inserting a terminal position assurance device defining a lance within the cavity until the lance contacts the attachment portion of the terminal, thereby securing the terminal within the cavity.

In an example embodiment having one or more features of the method of any one of the previous paragraphs, the lance is formed of a dielectric material.

In an example embodiment having one or more features of the method of any one of the previous paragraphs, the method further includes the step of positioning the lance between the first and second cables, thereby electrically insulating first cable from the second cable.

In an example embodiment having one or more features of the method of any one of the previous paragraphs, the terminal is a first terminal having a first connection portion and a first attachment portion and the cavity is a first cavity. The method further includes the steps of:

providing a second terminal having a second connection portion and having a second attachment portion, wherein the second attachment portion has a planar shape;

attaching a third wire electrical cable to the second attachment portion;

attaching a fourth wire electrical cable to the second attachment portion, wherein the third cable has a different cross-sectional area than the fourth cable; and inserting the second terminal within the second cavity.

In an example embodiment having one or more features of the method of any one of the previous paragraphs, the second terminal is rotated 180 degrees relative to the first terminal prior to insertion within the second cavity.

In an example embodiment having one or more features of the method of any one of the previous paragraphs, the first cable has the same cross-sectional area as the third cable and the second cable has the same cross-sectional area as the fourth cable.

According to yet another embodiment of the invention, a splice connector assembly configured to conduct more than 1 kilowatt of electricity is provided. The splice connector assembly includes a terminal having means for attaching the terminal to a first wire electrical cable and a second wire electrical cable. A first cross-sectional area of the first cable is at least 25 square millimeters and a second cross-sectional area of the second cable is greater than first cross-sectional area. The splice connector assembly also includes a dielectric housing defining a cavity in which the terminal is disposed.

BRIEF DESCRIPTION OF THE DRAWINGS

The present invention will now be described, by way of example with reference to the accompanying drawings, in which.

DETAILED DESCRIPTION

Figure 1:
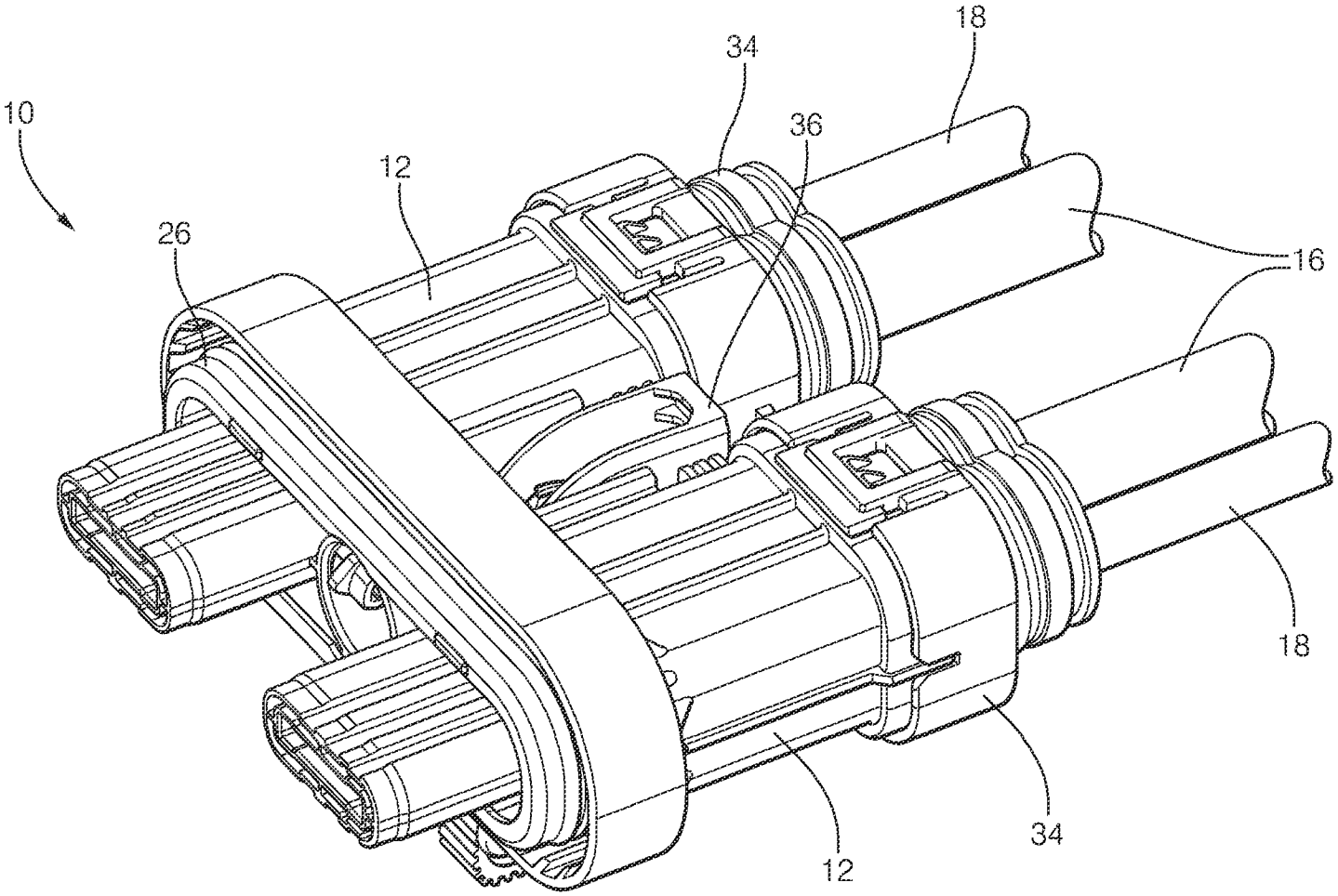
FIG. 1 is a top view of a splice connector assembly in accordance with an embodiment of the invention.
Figure 2:
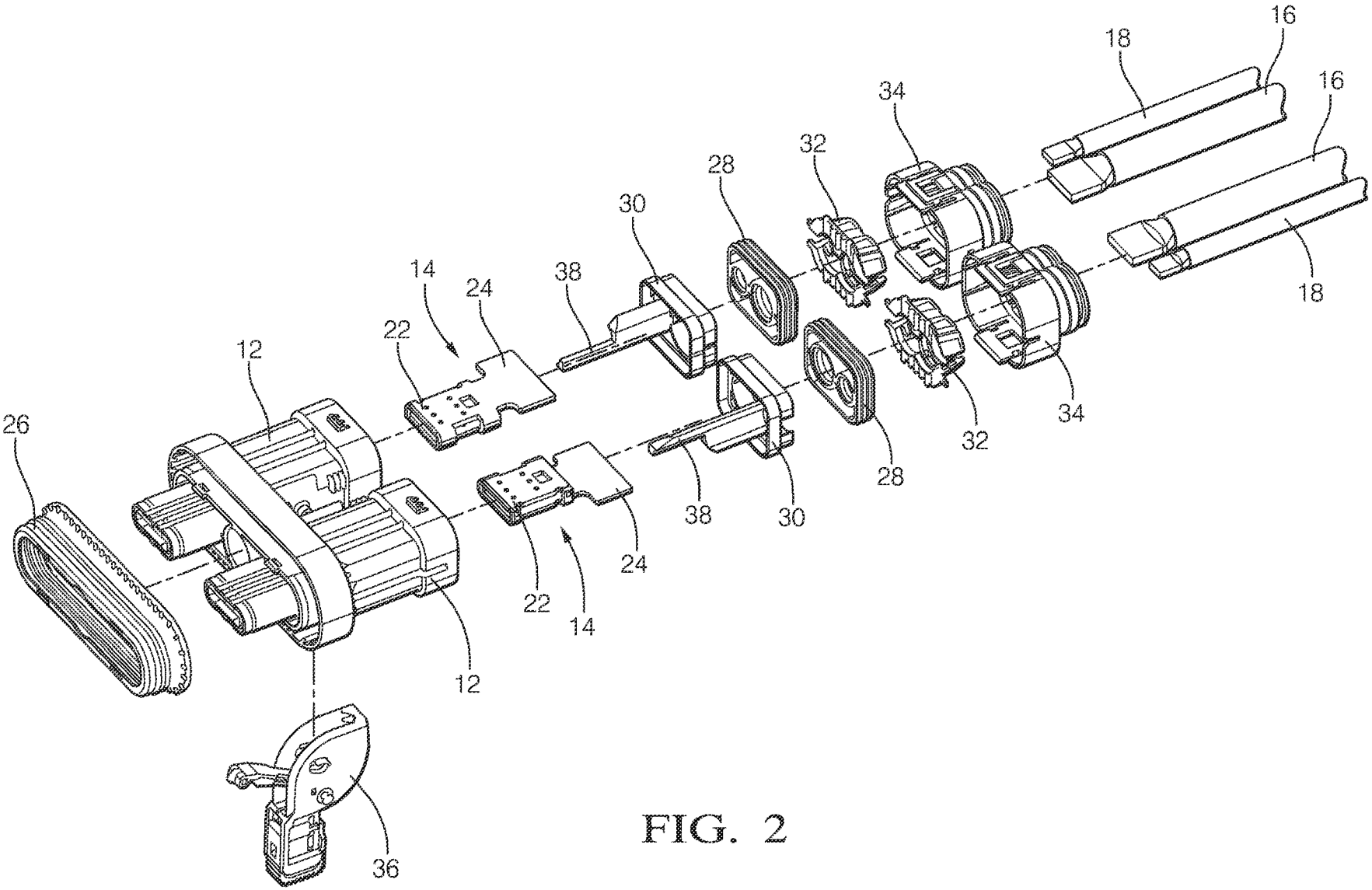
FIG. 2 is an exploded view of the splice connector assembly of FIG. 1 in accordance with the embodiment of the invention.
Figure 3:
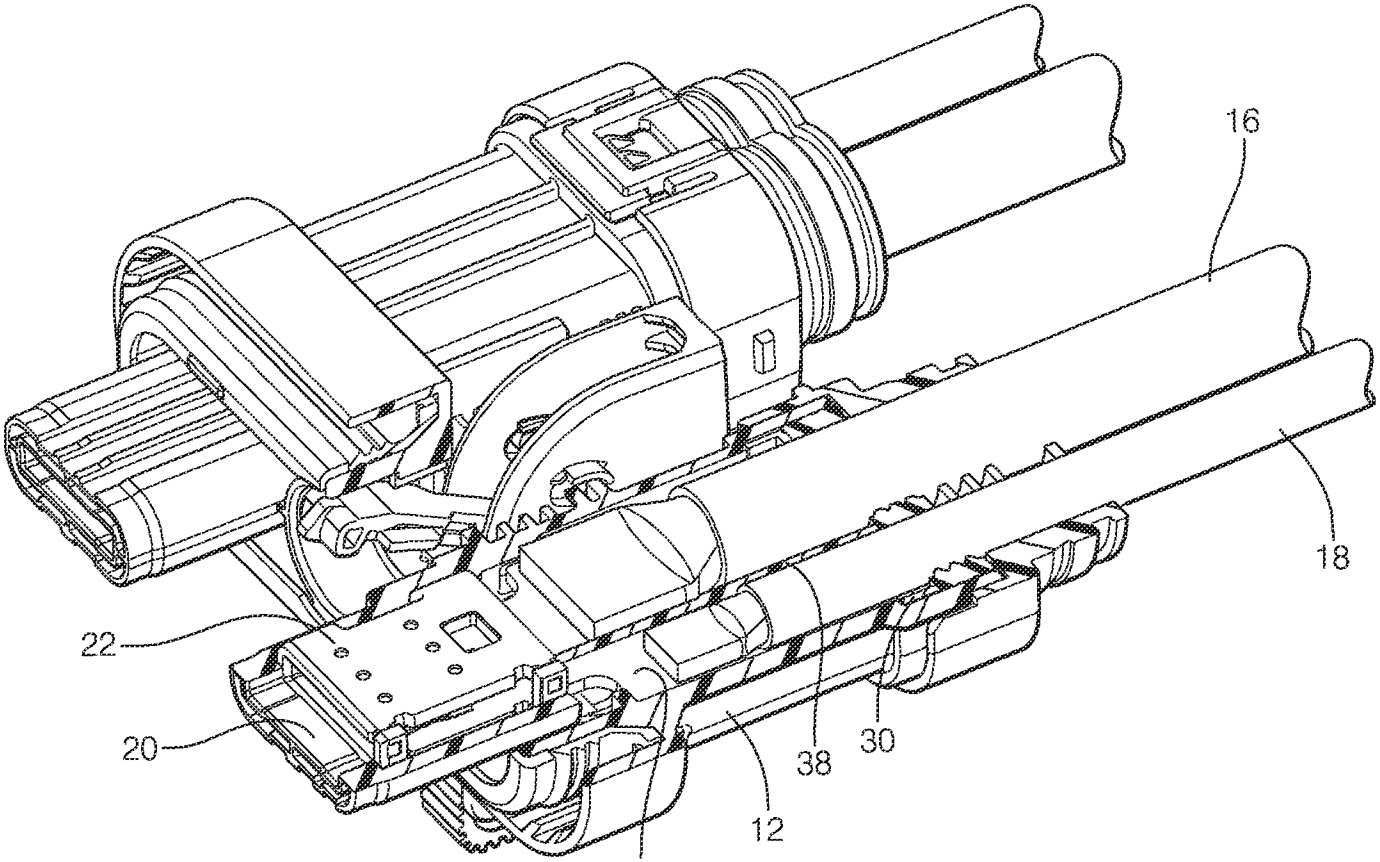
FIG. 3 is a cut-away view of the splice connector assembly of FIG. 1 in accordance with the embodiment of the invention.
Figure 4:
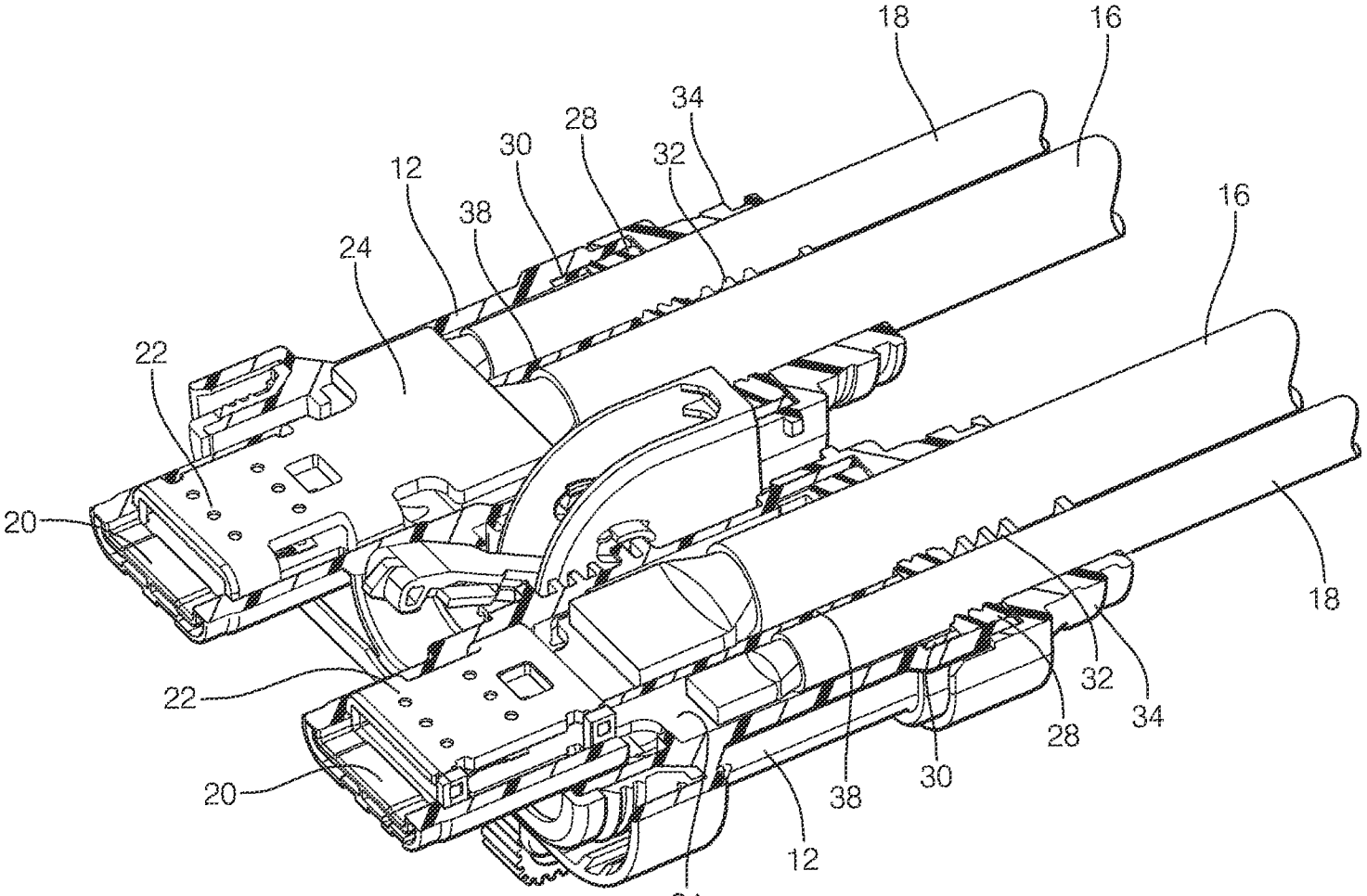
FIG. 4 is another cut-away view of the splice connector assembly of FIG. 1 in accordance with the embodiment of the invention.

A splice connector assembly is presented herein. The splice connector assembly eliminates the need for a Y-splice in the high power circuit by connecting two wire cables to a terminal that is connected directly to the power source, e.g. a battery pack in an electric or hybrid electric vehicle.

As shown in the non-limiting example of FIGS. 1-4, a splice connector assembly 10 includes a pair of insulative housings 12 formed of a dielectric material, such as polyamide (PA, also known as nylon), polybutylene terephthalate (PBT), or another engineered dielectric polymer. Electrically conductive terminals 14 are connected to two separate wire cables 16, 18 and are disposed within cavities 20 in the housings 12. The terminal may be formed from sheet metal, such as a copper or bronze sheet. Each terminal 14 has a connection portion 22 configured to receive a corresponding mating terminal (not shown) of a corresponding mating connector (not shown) and an attachment portion 24 configured to attach the wire cables 16, 18 to the terminal 14. The illustrated connection portion 22 is a female socket configured to receive a rectangular male blade of the corresponding mating terminal. Alternative embodiments may be envisioned in which the connector portion is a square or round socket configured to receive a square or round male pin of the corresponding mating terminal. In yet other alternative embodiments, the connection portion 22 may be a male pin or blade configured to be received in a female socket of the corresponding mating terminal. The attachment portion 24 is a planar sheet integrally connected to the connection portion 22. The wire cables 16, 18 are directly attached to the attachment portion 24 by a joining process such as sonic welding, resistance welding, soldering, or resistance brazing.

While the illustrated example of the splice connector assembly 10 includes a pair of housings 12 and terminals 14, alternative embodiments of the splice connector assembly may have a single housing and terminal or include more than two housings and terminals.

The illustrated splice connector assembly 10 also includes seals 26, 28 configured to inhibit the intrusion of environmental contaminants, such as dust and water, into the housing cavity that could cause corrosion of the terminal 14 and wire cables 16, 18. Depending on the application of the spice connector assembly, these seals may not be needed. The splice connector assembly 10 also includes terminal position assurance devices 30, cable strain relief devices 32, cable retainers 34, and a connector locking mechanism 36 configured to retain the splice connector assembly 10 to the corresponding mating connector.

The terminal position assurance devices 30 include lances 38 that extend from the terminal position assurance devices 30 and are configured to contact the attachment portion 24 of the terminal 14, thereby securing the terminals 14 within the cavities 20. The lances 38 are formed of a dielectric material. The lances 38 are positioned between the first and second cables 16, 18, thereby electrically insulating first cable 16 from the second cable 18.

While the illustrated example of the splice connector assembly 10 as shown and described is designed for use in an electrical vehicle, other embodiments of the splice connector assembly 10 may be adapted for conventional internal combustion vehicles, aerospace applications, industrial installations or other applications where such features are desired.

Figure 5:
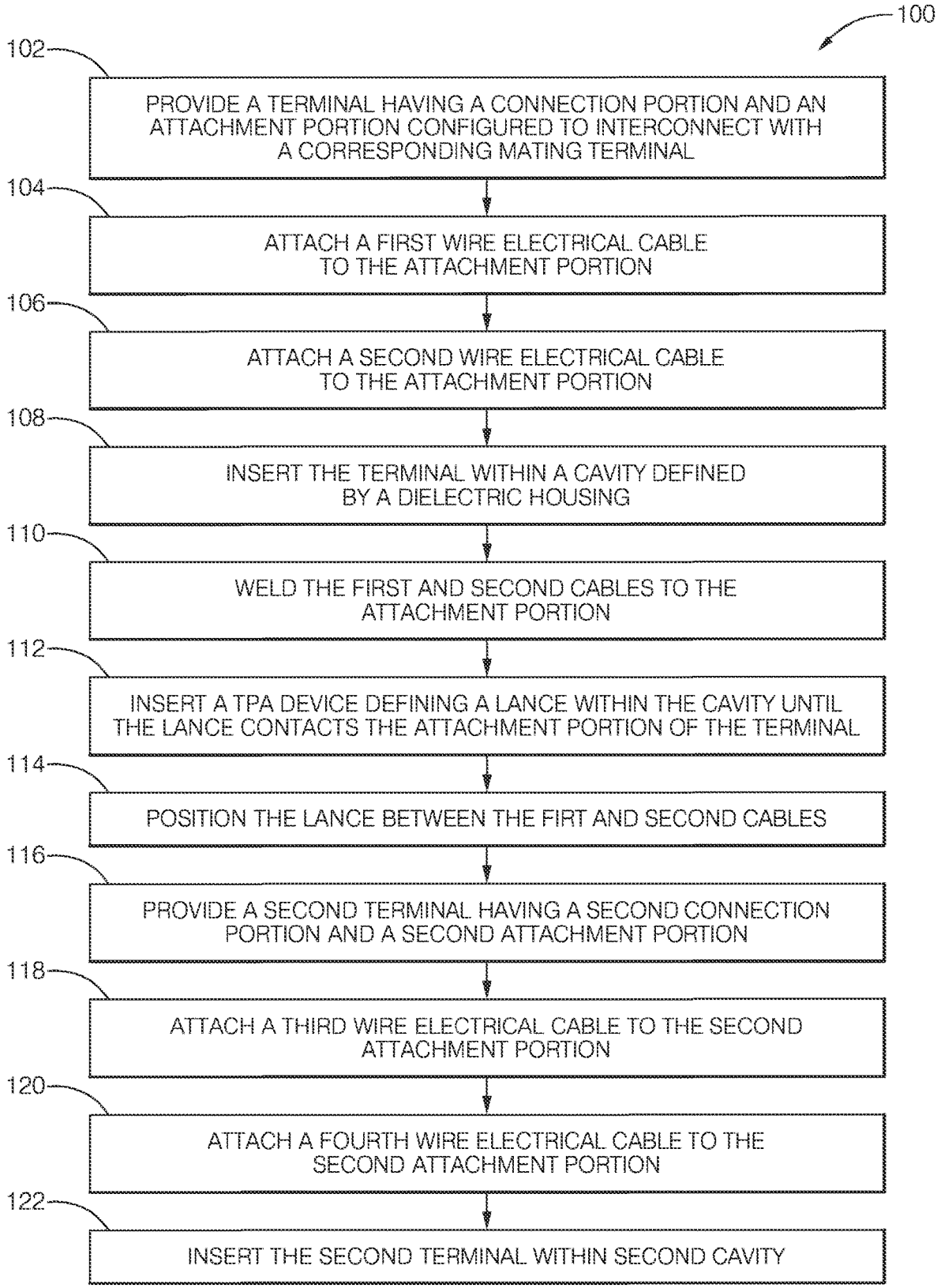
FIG. 5 is a flow chart of a method of assembling a splice connector assembly.

FIG. 5 illustrates a method 100 of assembling a splice connector assembly 10. The method 100 includes the following steps:

STEP 102, PROVIDE A TERMINAL HAVING A CONNECTION PORTION AND AN ATTACHMENT PORTION CONFIGURED TO INTERCONNECT WITH A CORRESPONDING MATING TERMINAL, includes providing a terminal 14 having a connection portion 22 and an attachment portion 24 configured to interconnect with a corresponding mating terminal. The attachment portion 24 has a planar shape;

STEP 104, ATTACH A FIRST WIRE ELECTRICAL CABLE TO THE ATTACHMENT PORTION, includes attaching a first wire electrical cable 16 to the attachment portion 24;

STEP 106, ATTACH A SECOND WIRE ELECTRICAL CABLE TO THE ATTACHMENT PORTION, includes attaching a second wire electrical cable 18 to the attachment portion 24. The first cable 16 has a different cross-sectional area than the second cable 18. A first cross-sectional area of the first cable 16 may be at least 25 square millimeters and a second cross-sectional area of the second cable 18 may be greater than first cross-sectional area;

STEP 108, WELD THE FIRST AND SECOND CABLES TO THE ATTACHMENT PORTION, is a sub-step of STEP 106 and includes welding the first and second cables 16, 18 to the attachment portion 24. The first and second cables 16, 18 may be sonically welded to the attachment portion 24;

STEP 110, INSERT THE TERMINAL WITHIN A CAVITY DEFINED BY A DIELECTRIC HOUSING, includes inserting the terminal 14 within a cavity 20 defined by a dielectric housing 12;

STEP 112, INSERT A TERMINAL POSITION ASSURANCE (TPA) DEVICE DEFINING A LANCE WITHIN THE CAVITY UNTIL THE LANCE CONTACTS THE ATTACHMENT PORTION OF THE TERMINAL, includes inserting a terminal position assurance device 30 defining a lance 38 within the cavity 20 until the lance 38 contacts the attachment portion 24 of the terminal 14, thereby securing the terminal 14 within the cavity 20. The lance 38 may be formed of a dielectric material;

STEP 114, POSITION THE LANCE BETWEEN THE FIRST AND SECOND CABLES is a sub-step of STEP 112 that includes positioning the lance 38 between the first and second cables 16, 18, thereby electrically insulating first cable 16 from the second cable 18;

STEP 116, PROVIDE A SECOND TERMINAL HAVING A SECOND CONNECTION PORTION AND A SECOND ATTACHMENT PORTION, includes providing a second terminal 14 having a second connection portion 22 and having a second attachment portion 24. The second attachment portion 24 has a planar shape;

STEP 118, ATTACH A THIRD WIRE ELECTRICAL CABLE TO THE SECOND ATTACHMENT PORTION, includes attaching a third wire electrical cable 16 to the second attachment portion 24;

STEP 120, ATTACH A FOURTH WIRE ELECTRICAL CABLE TO THE SECOND ATTACHMENT PORTION, includes attaching a fourth wire electrical cable 18 to the second attachment portion 24. The third cable 16 has a different cross-sectional area than the fourth cable 18; and STEP 122, INSERT THE SECOND TERMINAL WITHIN THE SECOND CAVITY, includes inserting the second terminal 14 within the second cavity 20.

The second terminal 14 may be rotated 180 degrees relative to the first terminal 14 prior to insertion within the second cavity 20. The first cable 16 may have the same cross-sectional area as the third cable 16 and the second cable 18 may have the same cross-sectional area as the fourth cable 18.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

We claim:

1. A high power splice connector assembly configured to conduct more than 1 kilowatt of electricity, comprising:

a terminal having a connection portion configured to conduct a first current and to interconnect with a corresponding mating terminal and having an attachment portion, wherein the attachment portion has a planar shape, wherein the attachment portion is attached to a first wire electrical cable configured to conduct a second current and is also attached to a second wire electrical cable configured to conduct a third current, and wherein the first cable has a different cross-sectional area than the second cable; and a dielectric housing defining a cavity in which the terminal is disposed.

2. The high power splice connector of claim 1, wherein a first cross-sectional area of the first cable is at least 25 square millimeters and a second cross-sectional area of the second cable is greater than first cross-sectional area.

3. The high power splice connector of claim 1, wherein the first and second cables are welded to the attachment portion.

4. The high power splice connector of claim 3, wherein the first and second cables are sonically welded to the attachment portion.

5. The high power splice connector of claim 1, further comprising a terminal position assurance device defining a lance configured to contact the attachment portion of the terminal, thereby securing the terminal within the cavity.

6. The high power splice connector of claim 5, wherein the lance is formed of a dielectric material and wherein the lance is positioned between the first and second cables, thereby electrically insulating first cable from the second cable.

7. The high power splice connector of claim 1, wherein the terminal is a first terminal having a first connection portion and a first attachment portion and the cavity is a first cavity, wherein the assembly further comprises a second terminal having a second connection portion and having a planar second attachment portion, wherein the second attachment portion is attached to a third wire electrical cable and is also attached to a fourth wire electrical cable, wherein the third cable has a different cross-sectional area than the second cable, and wherein the housing defines a second cavity in which the second terminal is disposed.

8. The high power splice connector of claim 7, wherein the second terminal is rotated 180 degrees relative to the first terminal.

9. The high power splice connector of claim 7, wherein the first cable has the same cross-sectional area as the third cable and the second cable has the same cross-sectional area as the fourth cable.

10. A method of assembling a high power splice connector assembly configured to conduct more than 1 kilowatt of electricity, comprising:

providing a terminal having a connection portion configured to conduct a first current and to interconnect with a corresponding mating terminal and having an attachment portion, wherein the attachment portion has a planar shape;

attaching a first wire electrical cable configured to conduct a second current to the attachment portion;

attaching a second wire electrical cable configured to conduct a third current to the attachment portion, wherein the first cable has a different cross-sectional area than the second cable; and inserting the terminal within a cavity defined by a dielectric housing.

11. The method of claim 10, wherein a first cross-sectional area of the first cable is at least 25 square millimeters and a second cross-sectional area of the second cable is greater than first cross-sectional area.

12. The method of claim 10, further comprising welding the first and second cables to the attachment portion.

13. The method of claim 12, further comprising sonically welding the first and second cables to the attachment portion.

14. The method of claim 10, further comprising inserting a terminal position assurance device defining a lance within the cavity until the lance contacts the attachment portion of the terminal, thereby securing the terminal within the cavity.

15. The method of claim 14, wherein the lance is formed of a dielectric material.

16. The method of claim 15, further comprising positioning the lance between the first and second cables, thereby electrically insulating first cable from the second cable.

17. The method of claim 10, wherein the terminal is a first terminal having a first connection portion and a first attachment portion and the cavity is a first cavity and wherein the method further comprises:

providing a second terminal having a second connection portion and having a second attachment portion, wherein the second attachment portion has a planar shape;

attaching a third wire electrical cable to the second attachment portion;

attaching a fourth wire electrical cable to the second attachment portion, wherein the third cable has a different cross-sectional area than the fourth cable; and inserting the second terminal within the second cavity.

18. The method of claim 17, wherein the second terminal is rotated 180 degrees relative to the first terminal prior to insertion within the second cavity.

19. The method of claim 17, wherein the first cable has the same cross-sectional area as the third cable and the second cable has the same cross-sectional area as the fourth cable.

20. A high power splice connector assembly configured to conduct more than 1 kilowatt of electricity, comprising:

a terminal configured to conduct a first current having means for attaching the terminal to a first wire electrical cable configured to conduct a second current and a second wire electrical cable configured to conduct a third current, wherein a first cross-sectional area of the first cable is at least 25 square millimeters and a second cross-sectional area of the second cable is greater than first cross-sectional area; and a dielectric housing defining a cavity in which the terminal is disposed.

* * * * *